United States Patent [19]

Pallmeyer

[11] Patent Number: 4,660,265

[45] Date of Patent: Apr. 28, 1987

[54] CONTINUOUS SEAM-FORMING DEVICE

[75] Inventor: Henry L. Pallmeyer, Dix Hills, N.Y.

[73] Assignee: Grumman Aerospace Corporation, Bethpage, N.Y.

[21] Appl. No.: 797,082

[22] Filed: Nov. 12, 1985

[51] Int. Cl.[4] ..... B23P 11/00

[52] U.S. Cl. ..... 29/243.5

[58] Field of Search ..... 29/243.5, 243.57, 243.58; 72/51, 210, 248

[56] References Cited

U.S. PATENT DOCUMENTS

| | | | |
|---|---|---|---|
| 354,654 | 12/1886 | Puddefoot . | |
| 355,108 | 12/1886 | Small . | |
| 478,723 | 7/1892 | Totten . | |
| 558,735 | 4/1896 | Luckett . | |
| 643,334 | 2/1900 | Sagendorph | 29/243.5 |
| 1,377,305 | 5/1921 | Brown et al. . | |
| 1,878,622 | 9/1932 | Deacon et al. . | |
| 1,912,128 | 5/1933 | Deacon et al. . | |
| 2,212,715 | 8/1940 | Levan . | |
| 2,233,937 | 3/1941 | Hexdall . | |
| 2,825,384 | 3/1958 | Goldsmith . | |
| 3,197,850 | 8/1965 | Gracer . | |
| 3,407,640 | 10/1968 | Lipp . | |
| 3,528,167 | 9/1970 | Lipp . | |
| 3,771,482 | 11/1973 | Thompson . | |
| 3,875,642 | 4/1975 | Knudson . | |
| 3,967,430 | 7/1976 | Knudson . | |
| 4,470,186 | 9/1984 | Knudson | 29/243.5 |

*Primary Examiner*—Robert C. Watson

*Attorney, Agent, or Firm*—Pollock, VandeSande & Priddy

[57] ABSTRACT

A device "zips" along two adjacent sheets of material and guides two confronting edge portions thereof into convoluted interlocking relationship. This forms a continuous seam between the sheets and enables the creation of a multi-section antenna ground plane free of RF leakage at the seams therebetween.

5 Claims, 3 Drawing Figures

CONTINUOUS SEAM-FORMING DEVICE

FIELD OF THE INVENTION

The present invention relates to seam-forming devices, and more particularly to such devices for interlocking two sheets of material along adjacent edges.

BACKGROUND OF THE INVENTION

In a number of applications for space-based radars, collapsed antennas and ground planes are loaded into a space craft; and after reaching a particular orbit, each collapsed antenna is deployed to an operating position. When this happens, it is often necessary to move a ground plane adjacent the antenna radiating elements. A problem has existed in accomplishing precise movement of a ground plane from a stored condition to an operative condition relative to the antenna, in a manner ensuring a continuous ground plane surface free from RF leaks.

BRIEF DESCRIPTION OF THE PRESENT INVENTION

In order to operate an array of such antennas, it is necessary to connect individual ground planes of the antennas in a continuous manner avoiding leaks of RF signals. This is accomplished by a seam-forming device which "zips" along confronting edges of adjacent ground planes to connect the edges into convoluted interlocking relationship. This forms a continuous seam between the sheets and enables the creation of a multi-section antenna ground plane free of RF leakage at the seams therebetween.

Although the invention is described for a space antenna ground plane, it is to be understood that the invention has applicability in forming seams in other sheet materials.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE PRESENT INVENTION

The present invention is related to a simple, reliable device for forming a continuous interlocking seam between confronting edges of sheet material.

Figure 1:
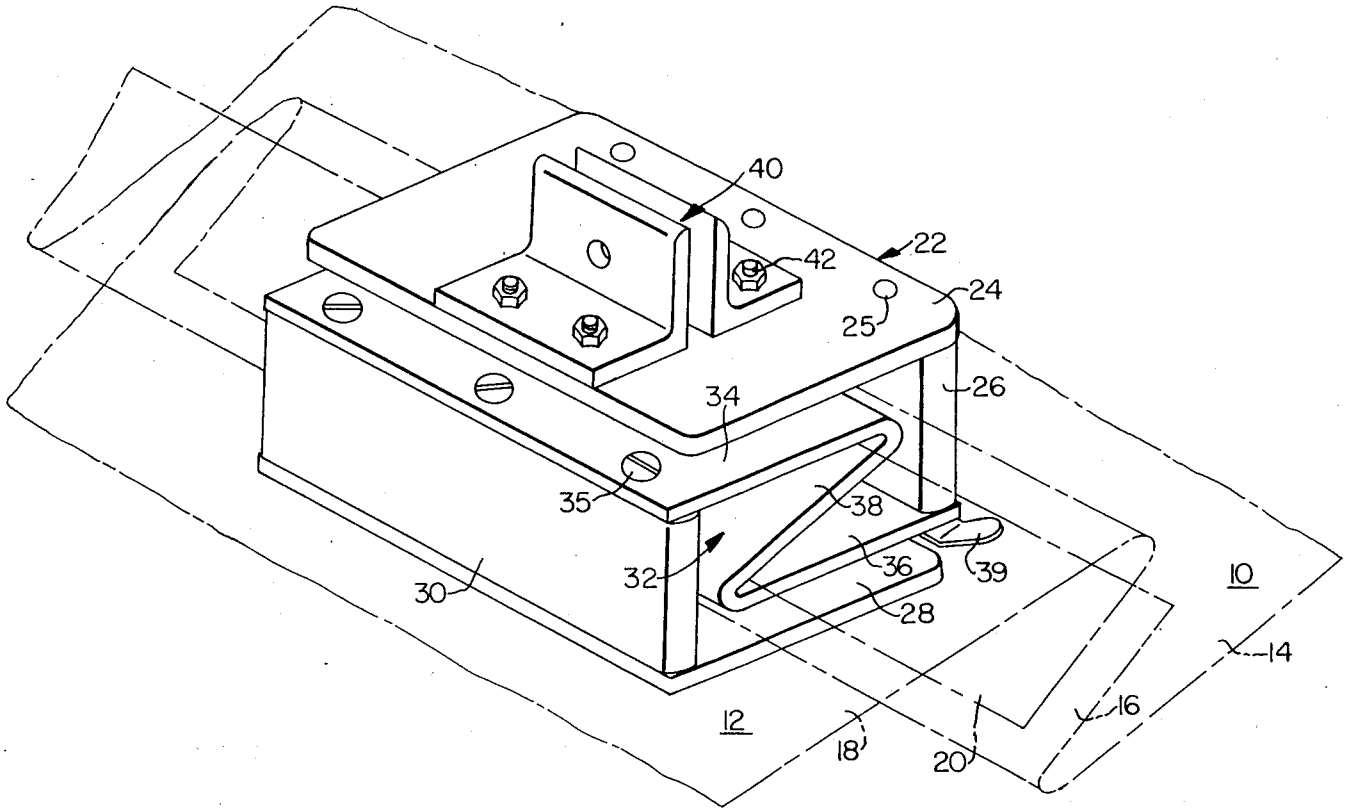
FIG. 1 is a perspective view of the present invention illustrating the formation of interlocking edge portions of two adjacent sheets.

Such edges are illustrated on two separate sheets of material 10 and 12, as shown in FIG. 1. In the space application previously discussed, edge portions of ground plane sheets are moved during deployment until the edge portions are in proximate location to one another. Each of the confronting edge portions of sheets 10 and 12 has a generally U-shaped bend. For example, sheet 10 includes a planar portion 14 which extends to the overlying edge portion 16. Likewise, a second sheet

12 includes a planar portion 18 extending to an overlying edge portion 20.

Figure 3:
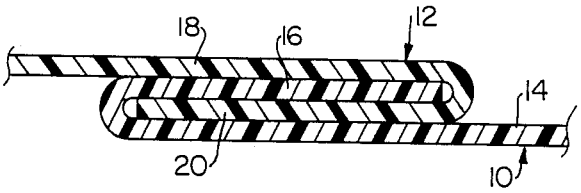
FIG. 3 is a cross-sectional view of the interlocking edge portions of two sheets after having been handled by the device of the invention.

After the sheets 10 and 12 are moved toward one another, it is necessary to form a continuous seam between them so that there is no leakage to RF energy. In order to do this, a zipper-like device is employed and is generally indicated by reference numeral 22. After the device engages sheets 10 and 12, it is run laterally along the confronting edges of the sheets and, as a result, an interlocking seam between the sheets is formed. In a preferred embodiment of the invention, the sheets have an resilient quality so that once the interlocking edge portions engage each other intimately, they will remain interlocked, as shown in FIG. 3. The sheet material may be metal so that it is opaque to RF signals. Another type of material which may be employed as a sheet base for a ground plane is KAPTON, which has excellent qualities for utilization in the harsh environment of space. Of course, the KAPTON would be metalized so that it is opaque to RF signals.

Figure 2:
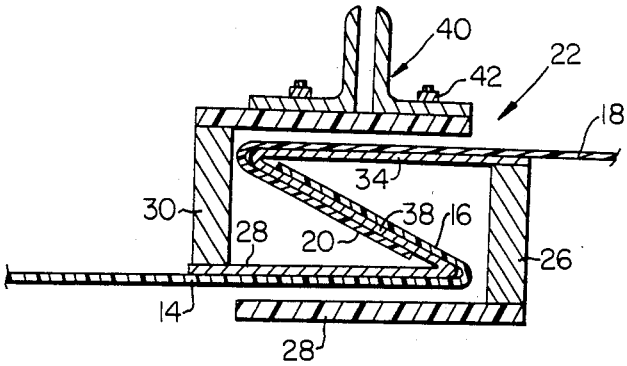
FIG. 2 is a cross-sectional view through the seam-forming device illustrating the sheet edge portions inserted therein.

Considering the device 22 in detail, reference is made to FIGS. 1 and 2 wherein the device is seen to include a top plate 24 connected to a side plate 26 by means of suitable fasteners such as rivets 25. A bottom plate 28 is spaced in parallel relationship to top plate 24 and is attached to a second side plate 30, located in spaced parallel relationship to plate 26. An elongated guide member generally indicated by reference numeral 32 is positioned between the top and bottom plate as well as the two side plates. The guide has a generally Z-shaped cross section which includes an upper flange 34 located in parallel spaced relationship to the top plate 24. An inclined web 38 is integrally formed with the upper flange 34 and extends to a bottom flange 36 which is located in parallel spaced relation to the bottom plate 28.

As the device 22 "zips" along the confronting edges of sheets 10 and 12, the guide 32 positions the preformed U cross section edge portions of the resilient sheets into interlocking relationship and, as the device passes a particular point along the interlocking edge portions, these edge portions are free to contract and intimately engage each other as shown in FIG. 3.

To consider the seam-forming operation, reference is made to FIGS. 1 and 2 wherein the upper illustrated surface of upper guide flange 34 is seen to receive the planar portion 18 of sheet 12. The outward edge portion 20 rests against the lower illustrated surface of web 38. In a similar manner, sheet 10 is engaged by guide 32 as follows. Planar portion 14 is received along the lower surface of flange 36 while edge portion 16 is received along the upper surface of web 38.

Other elements of device 22 include foot 39 which extends outwardly to engage the upper surface of planar portion 14 as an aid in positioning sheet 10 as device 22 is moved continuously along the interlocking edges of sheets 10 and 12.

In order to move device 22, a bifurcated mounting bracket 40 is secured, by suitable fasteners 42, to the top plate 24 of the device. A suitable actuator (not shown) is connected to bracket 40 for moving it along a linear path. However, the actuator device is not, per se, a part of the present invention; and other types of mounting brackets may be used.

After the device illustrated in FIGS. 1 and 2 continuously cause interlocking engagement of the edges of sheets 10 and 12, these edges will resiliently engage one another when free of the device to retain intimately engaging seam portions, as shown in FIG. 3. In this manner, a continuous seam is created which includes convolutions along the interlocking edge portions that prevent RF signal loss from antennas (not shown) located in proximity with a ground plane created by sheets 10 and 12.

Although the following invention has been explained in terms of its applicability to ground plane fabrication in space, it is to be appreciated that the device is not so limited and may be employed in a number of applications where interlocking edge portions of sheet material is desirable.

It should be understood that the invention is not limited to the exact details of construction shown and described herein, for obvious modifications will occur to persons skilled in the art.

I claim:

1. A device for forming a continuous seamed plane from two separate sheets of material having preformed bends along confronting edge portions, the device comprising:

first means for receiving the preformed edge portion of a first sheet;

second means for receiving the preformed edge portion of a second sheet in spaced non-contacting relation to the first sheet; and attachment means connected to the first and second receiving means for enabling movement thereof along the length of the preformed edge portions thereby causing contact between the edge portions and effecting their continuous interlocking relationship;

wherein the interlocking relationship at each point along the length of the edge portions remains after the device is moved past the point.

2. The device set forth in claim 1 wherein the first receiving means comprises a first flange for receiving an extended planar surface of the first sheet; and a web integrally connected at an acute angle with the first flange and having a first surface for receiving an edge portion of the first sheet.

3. A device for forming a continuous seamed plane from two separate sheets of material having preformed bends along confronting edge portions, the device comprising:

first means for receiving the preformed edge portion of a first sheet;

second means for receiving the preformed edge portion of a second sheet;

attachment means connected to the first and second receiving means for enabling movement thereof along the length of the preformed edge portions thereby guiding the edge portions into continuous interlocking relationship, wherein the interlocking relationship at each point along the length of the edge portions remains after the device is moved past the point;

further wherein the first receiving means comprises a first flange for receiving an extended planar surface of the first sheet; and a web integrally connected at an acute angle with the first flange and having a first surface for receiving an edge portion of the first sheet;

and further wherein the second receiving means comprises a second flange integrally connected to the web at an acute angle thereof to complete a guide for the two sheets, the guide having a generally Z-shaped cross section, an edge portion of the second sheet received on an opposite surface of the web.

4. The device set forth in claim 3 together with first and second means located in parallel spaced relation and outwardly from the first and second flanges for urging the edge portions into intimate interlocking relationship as the device is pulled along the edge portions of the sheets.

5. The structure set forth in claim 4 together with third and fourth means located in parallel spaced relationship and transversely oriented to the first and second flanges for urging the edge portions into intimate interlocking relationship as the device is pulled along the edge portions of the sheets.

* * * * *